US011708241B2

(12) United States Patent
Henneau et al.

(10) Patent No.: US 11,708,241 B2
(45) Date of Patent: Jul. 25, 2023

(54) METHOD FOR SELF-TESTING A MONITORING DEVICE MONITORING AN INTEGRITY STATUS OF A SUSPENSION MEMBER ARRANGEMENT IN AN ELEVATOR

(71) Applicant: Inventio AG, Hergiswil (CH)

(72) Inventors: Philippe Henneau, Zurich (CH); Vincent Robibero, Randolph, NJ (US); James Bibby, Wall Township, NJ (US)

(73) Assignee: INVENTIO AG, Hergiswil (CH)

( * ) Notice: Subject to any disclaimer, the term of this patent is extended or adjusted under 35 U.S.C. 154(b) by 854 days.

(21) Appl. No.: 16/623,630

(22) PCT Filed: Jun. 1, 2018

(86) PCT No.: PCT/EP2018/064400
§ 371 (c)(1),
(2) Date: Dec. 17, 2019

(87) PCT Pub. No.: WO2018/234007
PCT Pub. Date: Dec. 27, 2018

(65) Prior Publication Data

US 2020/0172375 A1 Jun. 4, 2020

(30) Foreign Application Priority Data

Jun. 21, 2017 (EP) ..... 17177162

(51) Int. Cl.
*B66B 5/00* (2006.01)
*B66B 7/12* (2006.01)

(52) U.S. Cl.
CPC ..... *B66B 5/0093* (2013.01); *B66B 7/1223* (2013.01)

(58) Field of Classification Search
CPC ..... B66B 5/00; B66B 5/0006; B66B 5/0018–0037; B66B 5/0093; B66B 5/02; B66B 5/12; B66B 5/125
See application file for complete search history.

(56) References Cited

U.S. PATENT DOCUMENTS 6,653,943 B2 11/2003 Lamb et al.
7,123,030 B2 10/2006 Robar et al.
(Continued)

FOREIGN PATENT DOCUMENTS

CN 1397797 A 2/2003
CN 1613740 A 5/2005
(Continued)

*Primary Examiner* — Christopher Uhlir
(74) *Attorney, Agent, or Firm* — William J. Clemens; Shumaker, Loop & Kendrick, LLP

(57) ABSTRACT

A method for self-testing a monitoring device monitoring an integrity status of an elevator suspension member arrangement includes the monitoring device having a voltage generation arrangement for generating electric voltages and applying the electric voltages to cords in suspension members of the suspension member arrangement. The monitoring device has a voltage analyzer arrangement for detecting a deterioration in the integrity status based on modifications in the applied electric voltages upon transmission through the cords. The method includes the steps of: specifically modifying the generated electric voltages to systematically induce modifications in the applied electric voltages upon transmission through the cords which, under normal operation conditions of the monitoring device, would be interpreted by the monitoring device as indicating the deterioration in the integrity status; verifying whether the deterioration in the integrity status is correctly detected; and initiating a self-test-failure-action if the deterioration in the integrity status is not correctly detected.

13 Claims, 2 Drawing Sheets

(56) References Cited

U.S. PATENT DOCUMENTS

| | | | | |
|---|---|---|---|---|
| 7,192,185 | B2 | 3/2007 | Lustenberger | |
| 8,011,479 | B2 | 9/2011 | Stucky et al. | |
| 8,424,653 | B2 | 4/2013 | Stucky et al. | |
| 8,807,286 | B2 * | 8/2014 | Puranen | B66B 7/062 73/158 |
| 9,828,216 | B2 * | 11/2017 | Berben | B66B 7/1223 |
| 9,862,571 | B2 | 1/2018 | Sun et al. | |
| 9,932,203 | B2 | 4/2018 | Robibero | |
| 9,975,734 | B2 | 5/2018 | Dold et al. | |
| 2008/0223668 | A1 | 9/2008 | Stucky et al. | |
| 2011/0284331 | A1 | 11/2011 | Stucky et al. | |
| 2013/0207668 | A1 | 8/2013 | Fargo et al. | |
| 2015/0362450 | A1 * | 12/2015 | Lehtinen | G01N 27/20 187/391 |

FOREIGN PATENT DOCUMENTS

| | | | |
|---|---|---|---|
| CN | 105073618 | A | 11/2015 |
| EP | 1730066 | B1 | 10/2010 |
| EP | 2266910 | A1 | 2/2012 |
| EP | 2441722 | A1 | 4/2012 |
| EP | 3124425 | A1 | 2/2017 |
| EP | 3124986 | A1 | 2/2017 |
| WO | 2005094248 | A2 | 10/2005 |
| WO | 2011098847 | A1 | 8/2011 |
| WO | 2013135285 | A1 | 9/2013 |
| WO | 2014095430 | A1 | 6/2014 |
| WO | 2017137282 | A1 | 8/2017 |
| WO | 2017137307 | A1 | 8/2017 |
| WO | 2017021265 | A1 | 9/2017 |
| WO | 2018141553 | A1 | 8/2018 |

* cited by examiner

METHOD FOR SELF-TESTING A MONITORING DEVICE MONITORING AN INTEGRITY STATUS OF A SUSPENSION MEMBER ARRANGEMENT IN AN ELEVATOR

FIELD

The present invention relates to an elevator with a monitoring device for monitoring an integrity status of a suspension member arrangement and to a method for operating the monitoring device.

BACKGROUND

Elevators typically comprise a car and, optionally, a counterweight which may be displaced for example within an elevator shaft or hoistway to different levels in order to transport persons or items for example to various floors within a building.

In a common type of elevators, the car and/or the counterweight are supported by a suspension member arrangement comprising several suspension member entities. A suspension member entity typically comprises a suspension member, a fixation arrangement for fixing the suspension member within the building and possibly other components which may be used e.g. upon monitoring an integrity of the suspension members. A suspension member may be a member which may carry heavy loads in a tension direction and which may be bent in a direction transverse to the tension direction. For example, a suspension member may be a rope or a belt. Typically, suspension members comprise a plurality of load carrying cords. The cords may be made for example with an electrically conductive material, particularly a metal such as steel. Such cords are typically embedded into an electrically isolating matrix material such as a polymer, the matrix material, inter alia, protecting the cords against e.g. mechanical damaging and/or corrosion.

During operation of the elevator, suspension members have to carry high loads and are typically repeatedly bent when running along for example a traction sheave, a pulley and/or other types of sheaves. Accordingly, substantial physical stress is applied to the suspension members during operation which may lead to deteriorations in the suspension members' physical characteristics such as e.g. their load bearing capability.

However, as elevators may typically be used by people for transportation along significant heights, safety requirements have to be fulfilled. For example, it has to be safeguarded that the suspension member arrangement can always guarantee safe support of the car and/or the counterweight. For such purposes, safety regulations rule for example that substantial deterioration of an initial load bearing capacity of a suspension member arrangement can be detected such that for example countermeasures such as replacing a substantially deteriorated or faulty suspension member from the suspension member arrangement may be initiated.

For example, various approaches to be used upon monitoring suspension members in an elevator have been described in EP 1 730 066 B1, U.S. Pat. No. 7,123,030 B2, US 2011/0284331 A1, U.S. Pat. No. 8,424,653 B2, US 2008/0223668 A1, U.S. Pat. No. 8,011,479 B2, US 2013/0207668 A1, WO 2011/098847 A1, WO 2013/135285 A1, EP 1 732 837 B1, and in a research article of Huaming Lei et al.: "Health Monitoring for Coated Steel Belts in an Elevator System" in the Journal of Sensors, Volume 2012, Article ID 750261, 5 pages, doi: 10.1155/2012/750261.

Most of these prior art approaches are generally based on measuring electrical resistance characteristics upon applying an electrical direct current (DC).

Further approaches for methods and devices for detecting deteriorations in load bearing suspension members of an elevator have been proposed by the present applicant, these approaches relying on AC voltage measurements. These approaches have been described by the present applicant inter alia in PCT/EP2016/067966, EP 16155357.3, EP 16155358.1, PCT/EP2017/052064, PCT/EP2017/052281 and EP 17166927. Furthermore, the applicant of the present application has filed a US provisional application U.S. 62/199,375 and a US non-provisional application U.S. Ser. No. 14/814,558 (now U.S. Pat. No. 9,932,203 B2) which relate to a more generalized approach for determining deteriorations in a suspension member arrangement for an elevator. All these documents are herein later on referred to as "the applicant's prior art". It shall be emphasized that many technical details of the "applicant's prior art" may also be applied to the present invention and that some technical characteristics of the present invention may be better understood upon studying "the applicant's prior art". Accordingly, the content of the "applicant's prior art" shall be incorporated herein by reference.

SUMMARY

There may be a need for an improvement in and/or an alternative for a method and a monitoring device to be used in an elevator for monitoring an integrity status of a suspension member arrangement. Particularly, there may be a need for increasing a reliability in applying a monitoring device during operation of an elevator.

According to a first aspect of the invention, a method for self-testing a monitoring device monitoring an integrity status of a suspension member arrangement in an elevator is proposed. Therein, the monitoring device is configured for generating electric voltages and applying the electric voltages to cords comprised in suspension members of the suspension member arrangement. Furthermore, the monitoring device is configured for detecting a deterioration in the integrity status based on modifications in the applied electric voltages upon transmission through the cords. The method comprises the following steps, preferably in the indicated order: (i) specifically modifying the generated electric voltages in a way such as to systematically induce modifications in the applied electric voltages upon transmission through the cords which, under normal operation conditions of the monitoring device, would be interpreted by the monitoring device as indicating the deterioration in the integrity status; (ii) verifying whether the deterioration in the integrity status is correctly detected; and (iii) initiating a self-test-failure-action if the deterioration in the integrity status is not correctly detected.

According to a second aspect of the invention, a monitoring device for monitoring an integrity status of a suspension member arrangement in an elevator is proposed. Therein, the monitoring device comprises a voltage generator arrangement and a voltage analyzer arrangement being configured as defined with respect to embodiments of the first aspect of the invention. Particularly, the monitoring device is configured for performing the method as defined with respect to embodiments of the first aspect of the invention.

According to a third aspect of the invention, an elevator comprising the monitoring device as defined with respect to embodiments of the second aspect of the invention is proposed.

Ideas underlying embodiments of the present invention may be interpreted as being based, inter alia and without restricting a scope of the invention, on the following observations and recognitions:

As already stated in the introductory portion, various methods have been developed and implemented into monitoring devices for monitoring an integrity status of a suspension member arrangement by applying electric voltages to cords comprised in the suspension members and supervising the electric voltages upon been transmitted along these cords, as it is generally assumed that any modification in the integrity status of a suspension member is compromised by modifications in electrical characteristics of the cords which themselves then result in modifications of the transmitted electric voltages.

Most of the existing approaches either generate and apply the electric voltages for enabling measuring of electrical resistances throughout the cords of the suspension members or generate and apply the electric voltages for enabling comparing electrical characteristics of two or more groups of cords.

In the latter approach, which has been mainly developed by the present applicant and is described in the applicant's prior art, electrical resistances do not necessarily have to be measured. Instead, two or more alternating current (AC) voltages are generated with a phase-shift with respect to each other and each of the AC voltages is applied to one of the groups of cords. After having been transmitted through the groups of cords, the transmitted AC voltages are superimposed to each other at a so-called neutral point. The resulting superposition voltage may be referred to as neutral point voltage and may provide valuable information about the current integrity status of the suspension members comprising the groups of cords.

As an example, two AC voltages may be generated with a 180° phase-shift to each other. Each AC voltage may be applied at one end of one of two groups of cords. The opposing ends of both groups of cords may be electrically interconnected such as to establish a circuitry with a neutral point. Upon being transmitted through the one of two groups of cords, both alternating voltages are superimposed at the neutral point. As long as both groups of cords have same electrical characteristics, the AC voltages will "neutralize" each other at the neutral point, i.e. an AC component of the neutral point voltage is zero.

Accordingly, as long as no specific deteriorations occur within one of the groups of cords altering their electrical characteristics, a neutral point voltage with a vanishing AC component may be observed. However, for example upon any interruptions, breaks, modifications in electrical resistances due to for example local corrosion of cords, etc. occur in only one of the groups of cords, such non-symmetrical modification in the electrical characteristics of the groups of cords generally result in the neutral point voltage obtaining a non-zero AC component. Accordingly, the monitoring device would interpret such occurrence of a non-zero AC component as indicating a substantial deterioration in the integrity status of the suspension members comprising the monitored groups of cords.

More details and options of possible implementations of such monitoring approach are described in the applicant's prior art. For example, the groups of cords may be organized in various ways, wherein one group of cords may comprise cords of a single suspension member or of plural suspension members. Furthermore, one group of cords may comprise a multiplicity of cords interconnected with each other in parallel, in series or in a combination of parallel and series connections. Specific connectors may be attached to the end regions of the suspension members in order to electrically contact and interconnect the cords of one group of cords.

While with the described approaches for monitoring an integrity status of suspension members in an elevator, specific deteriorations in the suspension members may be detected with high reliability, it has been found that nevertheless situations may occur in which any substantial deterioration is in the suspension members are not correctly detected.

Particularly, it has been found that such situations may occur upon any malfunctions within the monitoring device itself. It is of course of basic importance that the monitoring device executing the monitoring method is always correctly functioning.

For example, in the monitoring approach in which a zero AC component of a neutral point voltage is taken as indicating that no substantial deteriorations or deviations between electrical characteristics of groups of cords in suspension members are present, a situation may occur in which the AC voltage generation itself is faulty or for example an electrical connection between an alternating voltage generator arrangement and the cords in the suspension members is faulty. In such situation, no AC voltages are generated and/or applied to the groups of cords. This of course results in a neutral point voltage being zero which, under normal operation conditions of the monitoring device, would be interpreted as indicating "no deterioration in the integrity status". However, such interpretation is not necessarily correct as, in the described situation, the monitoring device itself is faulty and may no more provide any reliable information about a current integrity status.

It is therefore proposed to provide a method for self-testing the monitoring device. Such self-testing shall enable detecting whenever the monitoring device is faulty. If failures in the monitoring device are detected, suitable actions, referred to herein as self-test-failure-actions, may be initiated.

For example, as an option for a self-test-failure-action, an operation of the entire elevator may be immediately stopped as its safety may no more guaranteed if the integrity of the suspension members may no more be reliably monitored. Alternatively or additionally, alarms may be issued. For example, an alarm signal may be submitted to a maintenance service provider and/or an elevator manufacturer. Particularly, an alarm signal may be submitted to a remote control center supervising the safety of the elevator. As a further alternative or additionally, instead of completely stopping the operation of the entire elevator, operation of the elevator may be temporarily modified for enabling for example an evacuation of passengers. For example, travelling velocities may be temporarily reduced. Further alternative or additional self-test-failure-actions may be initiated.

Specifically, the self-testing method comprises a step in which the monitoring device is specifically controlled such as to modify the generated electric voltages in a way in which modifications in the applied electrical voltages after transmission through the cords of the suspension members are systematically induced in a way such that they would be interpreted by the monitoring device as indicating a substantial deterioration in the integrity status. Accordingly, by systematically driving the voltage generator arrangement of the monitoring device into such condition, the monitoring device, under normal operation conditions, should then detect the deterioration in the integrity status. This is verified within the self-testing method. In case it is detected that the monitoring device did not correctly detect the deterioration in the integrity status, this may be taken as an indicator indicating that any failure occurred within the monitoring device itself. In such situation, for example a predetermined self-test-failure-action may be initiated.

In fact, a variety of self-test procedures are imaginable. For example, complex testing of the voltage generator arrangement and/or all wiring and connectors used for establishing the electrical connection between the monitoring device and the suspension members to be monitored could be implemented. However, such complex testing would generally require further hardware and/or efforts, thereby resulting in significantly increased costs for the monitoring device.

In order to, inter-alia, reduce the effort and cost for implementing a self-testing procedure, it is proposed herein to employ intrinsic capabilities of the monitoring device for implementing the self-testing procedure without necessarily needing any additional hardware.

Specifically, it is employed that, in a monitoring device, the voltage generator arrangement for generating the voltage to be applied at one end of cords of the suspension member, on the one hand, and a voltage analyzer arrangement for analyzing the resulting voltage after transmission through the cords at an opposing end of the cords or groups of cords, on the other hand, are implemented as separate devices or at least as separate components in a common device. In other words, the voltage generation may be independently controlled and the voltage analysis may be independently performed. Accordingly, under normal operation conditions, the voltage analyzer arrangement continuously or repeatedly analyzes resulting voltages after transmission through the cords and detects whether there are any deviations from a predetermined standard behavior of such resulting voltages. In case of such deviations, the voltage analyzer arrangement initiates for example countermeasures and/or alarms. However, the voltage analyzer arrangement generally does not check whether the deviations in fact result from electrical properties of the monitored cords having changed over the time or whether, instead, the voltages originally applied to the cords have changed due to for example a faulty voltage generator arrangement.

This fact of voltage generation and voltage analyses being generally independent from each other is used in the proposed self-testing method. Therein, normally monitoring the suspension member arrangement is briefly interrupted and instead of generating standard voltages at the voltage generator arrangement, the generated voltages are temporarily modified in such a way that, after transmission through the cords, the resulting voltages are interpreted by the voltage analyzer arrangement as substantially deviating from the predetermined standard behavior, i.e. as indicating a substantial deterioration in the integrity status of the suspension member arrangement.

Accordingly, if the voltage analyzer arrangement correctly detects the supposed deterioration in the integrity status during the self-testing method, it may be assumed that the monitoring device is correctly operating and its components, circuitry and electrical connections to the suspension members are correctly working.

However, if the supposed deterioration in the integrity status is not correctly detected, this may indicate that there is any failure within the monitoring device. For example, the voltage generator arrangement may be faulty and may no more correctly generate voltages. Or a circuitry or electrical connectors for establishing an electrical connection between the voltage generator arrangement and the cords in the suspension members may be faulty such that any generated voltages are not correctly applied to the cords. Accordingly, suitable self-test-failure-actions shall be initiated in order to guarantee avoiding any unsafe operation of the elevator due to its suspension members no more being correctly monitored.

According to an embodiment, the monitoring device is specifically configured for implementing a monitoring procedure as described in more detail in the applicant's prior art. Specifically, the monitoring device is configured for generating first and second alternating electric voltages being phase-shifted with respect to each other. If only the first and second alternating voltages are generated, a phase shift of 180° may be preferred. However, optionally, more than two alternating voltages may be generated and applied to groups of cords wherein a phase shift between the alternating voltages may depend on the number of generated alternating voltages. Furthermore, the monitoring device is configured for analyzing a neutral point voltage resulting upon applying each one of the first and second alternating voltages to a first and a second group of cords comprised in suspension members of the suspension member arrangement, respectively, and after transmission of the first and second alternating voltages through the groups of cords and superimposing the transmitted first and second alternating voltages. Furthermore, the monitoring device is configured for detecting a first type of deterioration in the integrity status based on the analysis of the neutral point voltage. In such case, the method may be specifically adapted to the configuration and features of the monitoring device. Particularly, the method may comprise the following steps, preferably in the indicated order: (i) specifically modifying the generated first and second alternating electric voltages in a way such as to systematically induce modifications in the neutral point voltage upon transmission through the cords which, under normal operation conditions of the monitoring device, would be interpreted by the monitoring device as indicating the first type of deterioration in the integrity status; (ii) verifying whether the deterioration in the integrity status is correctly detected; and (iii) initiating a self-test-failure-action if the deterioration in the integrity status is not correctly detected.

In other words, in case the monitoring device is implemented in a way as briefly explained further above and as described in more detail in the applicant's prior art for generating phase-shifted alternating voltages, applying these alternating voltages to different groups of cords and then analyzing a superposition of these alternating voltages at the neutral point after being transmitted through the groups of cords, such specific configuration of the monitoring device may be used for implementing a suitable self-testing procedure. Therein, one or both of the generated alternating voltages are temporarily specifically modified such as to create an intended imbalance in the circuitry comprising both groups of cords. Accordingly, such imbalance results in the AC component of the neutral point voltage no more being zero. Under normal operation conditions, such deviation from a zero AC component should be detected by the monitoring device as indicating a substantial deterioration in the integrity status. If this is not the case, a failure or malfunction of the monitoring device itself may be assumed and suitable self-test-failure-actions may be initiated.

In a specific implementation of the preceding embodiment, the step of specifically modifying the generated first and second alternating electric voltages comprises temporarily switching-off the first alternating electric voltage while generating the second alternating electric voltage and verifying whether the deterioration in the integrity status is correctly detected, and subsequently temporarily switching-off the second alternating electric voltage while generating the first alternating electric voltage and verifying whether the deterioration in the integrity status is correctly detected. A self-test-failure-action shall then be initiated if the deterioration in the integrity status is not correctly detected in both cases.

In other words, during the self-testing procedure, the alternating voltage generator arrangement of the monitoring device may be specifically controlled such that, first, generation of the first alternating voltage is temporarily suspended while the second alternating voltage still being generated. Then, the situation is reversed, i.e. the second alternating voltage is temporarily suspended and the first alternating voltage is switched-on again. Under normal operation conditions, a deterioration in the integrity status should be detected by the monitoring device in both situations. If this is not the case in at least one of the situations, a failure within the monitoring device itself may be assumed and self-test-failure-actions should be initiated.

According to an embodiment, the monitoring device is specifically configured for implementing a further aspect of a monitoring procedure as described in more detail in the applicant's prior art. Specifically, the monitoring device is configured for generating electric voltages and for measuring resulting voltages after a voltage drop along cords comprised in suspension members of the suspension member arrangement upon application of a generated electric voltage. Furthermore, the monitoring device is configured for detecting a second type of deterioration in the integrity status based on a detected modification in the resulting voltages. In such configuration of the monitoring device, the proposed method may comprise the following steps, preferably in the indicated order: (i) specifically modifying the generated electric voltages in a way such as to systematically induce modifications in the resulting voltages which, under normal operation conditions of the monitoring device, would be interpreted by the monitoring device as indicating the second type of deterioration in the integrity status; (ii) verifying whether the deterioration in the integrity status is correctly detected; and (iii) initiating a self-test-failure-action if the deterioration in the integrity status is not correctly detected.

In other words, while with the features of the embodiment defined in the previous paragraphs, the monitoring device is adapted for detecting a first type of deterioration in the integrity status, in the present embodiment, the monitoring device is adapted for detecting a second type of deterioration. For example, the first type of deterioration may include any interruptions in the monitoring circuitry due to for example breakage of cords in the included suspension members. The second type of deterioration mainly refers to deteriorations in the cords which do not necessarily result in a complete interruption but which may for example modify an electrical resistance through the cords which may then modify the resulting voltage occurring at an opposing end of the cords after transmission through the cords. For example, such second type of deterioration may relate to any wear or corrosion in the cords, reducing their electrically conductive diameter and thereby increasing their electric resistance.

It shall be noted that a monitoring device may be, and preferably is, adapted for detecting both, the first and second types of deterioration. For that purpose, the voltage generator arrangement may generate for example electric voltages comprising both, an AC component and a DC component, and the voltage analyzer arrangement may analyze both, the AC component and the DC component, after transmission through the groups of cords, i.e. may analyze the neutral point voltage as well as analyze any voltage occurring after a voltage drop along the groups of cords.

For detecting the second type of deterioration, a voltage drop along the cords comprised in the suspension members may be measured or a voltage occurring as a result of such voltage drop may be measured. Therein, the voltage applied to the cords does not necessarily have to be an alternating voltage. Instead, the voltage may be a DC voltage, i.e. have a magnitude being constant over the time. Alternatively, the voltage may be a DC component of an alternating voltage, i.e. an entire voltage applied to the cords may be composed of a DC component with a steady magnitude and an AC component with an alternating amplitude. As a further alternative, voltage drops or resulting voltages may be measured and compared to each other for one specific phase of an alternating voltage being applied to the cords.

The second type of deterioration may then be detected based upon a voltage drop along the cords being for example out of an allowable range or a voltage resulting upon such voltage drop being out of an allowable range.

For example, for new, non-deteriorated suspension members, a voltage drop along the cords or a voltage resulting upon such voltage drop may be measured and taken as a reference value. Over the time, such voltage drop typically increases due to an increasing electrical resistance through the cords due to wear and corrosion. Some deterioration and corresponding increase in voltage drop may be allowable. However, if the deterioration exceeds a certain degree resulting in the voltage drop exceeding a predetermined value, this may be taken as indicating an excessive deterioration of the load bearing capacity of the suspension members such that countermeasures as for example exchanging the suspension members should be initiated.

In such configuration of the monitoring device, the self-testing procedure may comprise specifically modifying the generated electric voltages such that a resulting voltage after a voltage drop along the cords is induced which, under normal operation conditions, would be interpreted by the monitoring device as indicating the second type of deterioration. If such detection is not correctly executed, this may be taken as indicating that the monitoring device itself is faulty and that self-test-failure-actions should be initiated.

In a specific implementation of the preceding embodiment, the step of specifically modifying the generated first and second electric voltages comprises temporarily reducing an magnitude of the generated voltage to a value which is lower than a resulting voltage value which, under normal operation conditions of the monitoring device, would be interpreted by the monitoring device as indicating the second type of deterioration in the integrity status.

In other words, in order to intendedly provoking the voltage analyzer arrangement of the monitoring device to detect a deterioration in the integrity status of the second type, the voltage generator arrangement of the monitoring device may temporarily reduce the magnitude of the generated voltage to a value which would normally definitely result in a voltage after transmission through the cords being lower than an acceptable limit and being therefore interpreted by the voltage analyzer arrangement as indicating the deterioration of the second type. Accordingly, if the applied voltage is temporarily reduced but no deterioration of the second type is detected, this may be taken as indicating a failure or malfunction within the monitoring device itself.

According to an embodiment, the self-testing method may be repeated periodically during operation of the monitoring device.

In other words, the self-testing method is performed in predetermined time intervals. Accordingly, in such time intervals, normal operation of the monitoring device is briefly interrupted and the self-testing method is executed. As long as no failure within the monitoring device is detected, normal operation of the monitoring device may then be re-established.

The time intervals may be short, i.e. for example shorter than a few seconds (e.g. <10 s or <2 s) at least shorter than a few minutes (e.g. <10 min), as the self-testing procedure itself may be executed very rapidly, e.g. within milliseconds. A short periodicity in executing the self-testing method may guarantee that no failure in the monitoring device is ignored over a substantial time interval.

Alternatively, according to an embodiment, the self-testing method may be repeated upon occurrence of predetermined events during operation of the monitoring device.

In other words, the self-testing method may be performed every time a specific event occurs. For example, the self-testing method may be performed every time an elevator motion is started or stopped, i.e. at or before a start or at or after an end of a run of the elevator car. Such coupling of performing the self-testing method to the occurrence of specific events may reduce the number of interruptions of the normal monitoring activity of the monitoring device.

It shall be noted that possible features and advantages of embodiments of the invention are described herein partly with respect to a self-testing method, partly with respect to the monitoring device implementing such self-testing method and partly with respect to elevator including such monitoring device. One skilled in the art will recognize that the features may be suitably transferred from one embodiment to another and features may be modified, adapted, combined and/or replaced, etc. in order to come to further embodiments of the invention.

In the following, advantageous embodiments of the invention will be described with reference to the enclosed drawings. However, neither the drawings nor the description shall be interpreted as limiting the invention.

The figures are only schematic representations and are not to scale. Same reference signs refer to same or similar features throughout the figures.

DETAILED DESCRIPTION

Figure 1:
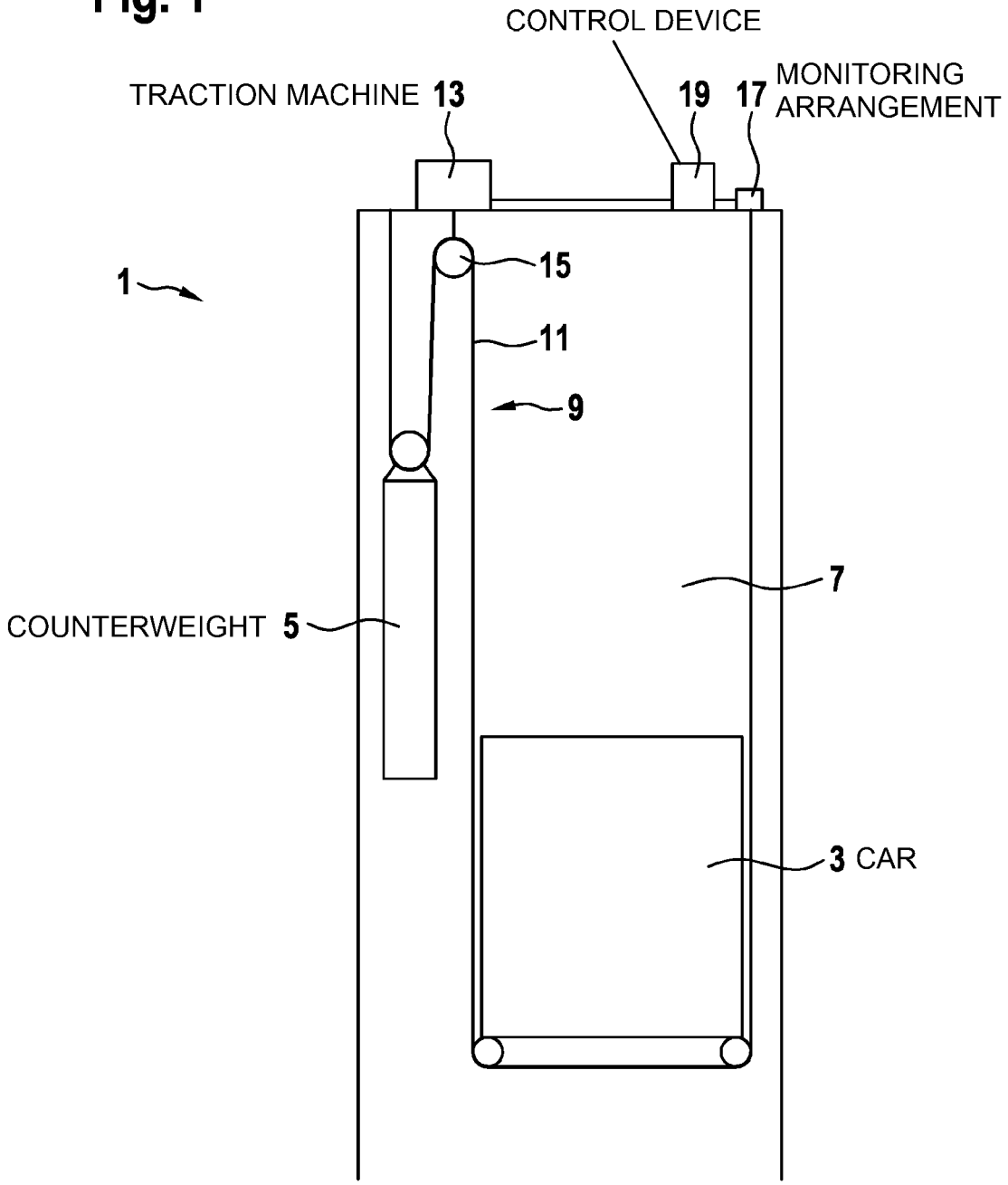
FIG. 1 shows an elevator in which a monitoring device according to an embodiment of the invention may be applied.

FIG. 1 shows an elevator 1 in which a monitoring device 17 may be implemented in accordance with embodiments of the present invention.

The elevator 1 comprises a car 3 and a counterweight 5 which may be displaced vertically within an elevator shaft 7. The car 3 and the counterweight 5 are suspended by a suspension member arrangement 9. This suspension member arrangement 9 comprises multiple suspension members 11, sometimes also referred to as suspension traction media (STM). Such suspension members 11 may be for example ropes, belts, etc. Furthermore, the elevator 1 comprises additional components such as, inter-alia, the monitoring device 17 for monitoring an integrity or deterioration status of the suspension members 11 in the suspension member arrangement 9.

In the example shown in FIG. 1, end portions of the suspension members 11 are fixed to a supporting structure of the elevator 1 at a top of the elevator shaft 7. The suspension members 11 may be displaced using an elevator traction machine 13 driving a traction sheave 15. An operation of the elevator traction machine 13 may be controlled by a control device 19.

It may be noted that the elevator 1 and particularly its suspension member(s) 11 and its monitoring device 17 for detecting the deterioration status may be configured and/or arranged in various other ways than those shown in FIG. 1. For example, instead of being fixed to the support structure of the elevator 1, the end portions of the suspension members 11 may be fixed to the car 3 and/or to the counterweight 5.

The suspension members 11 to be driven for example by the traction machine 13 may utilize metal cords or ropes to support a suspended load such as the car 3 and/or the counterweight 5 that is moved by the traction machine 13.

Figure 2:
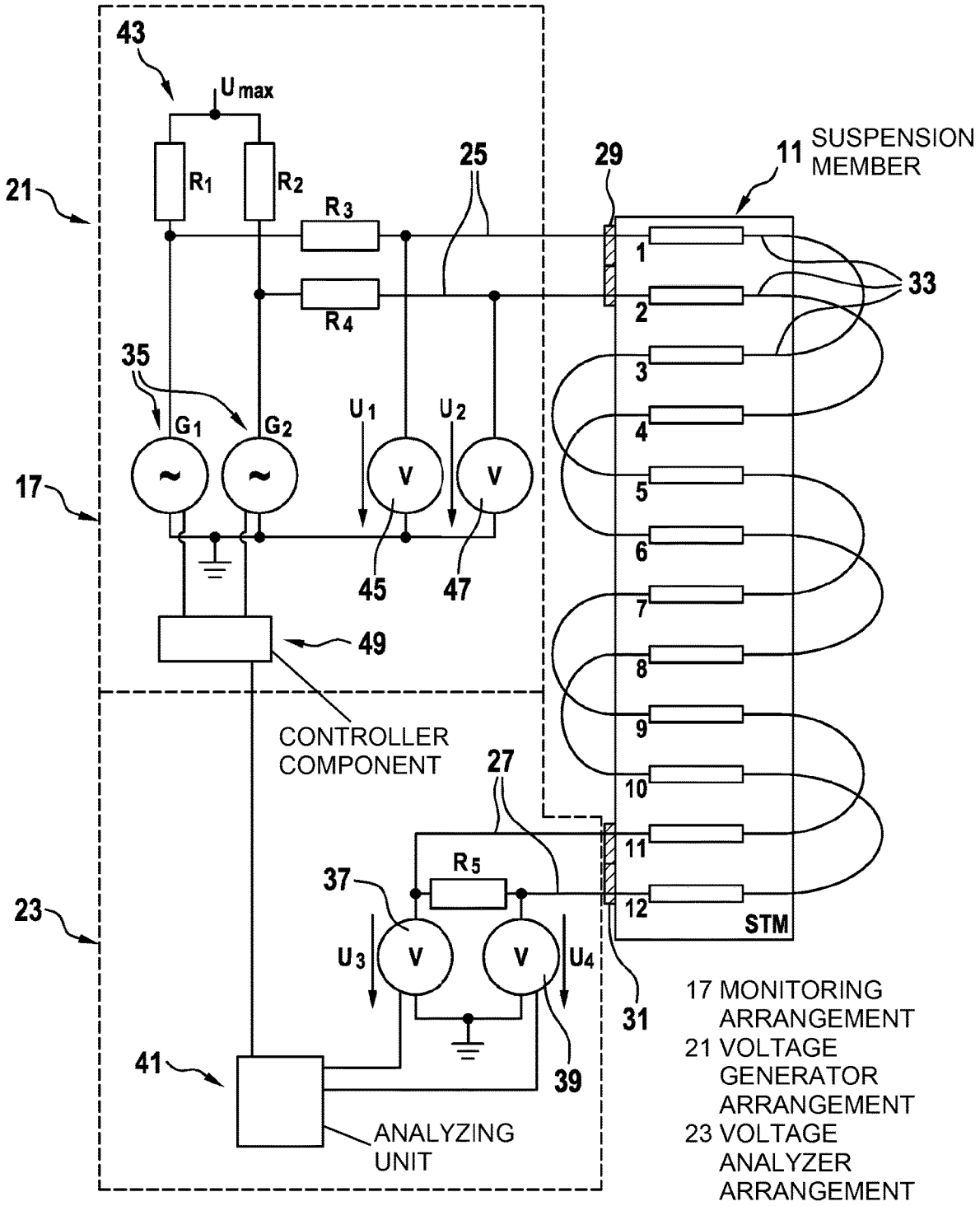
FIG. 2 shows main features of the monitoring device according to an embodiment of the invention as applied to a suspension member arrangement.

FIG. 2 schematically shows main features of a monitoring device 17 for monitoring an integrity status of the suspension member arrangement 9, in which a method for self-testing may be implemented in accordance with an embodiment of the present invention.

Details on possible operation principles of the monitoring device 17 are disclosed in the "applicant's prior art" (for example an overview is given in PCT/EP2016/067966) and shall only be briefly summarized herein.

The monitoring device 17 comprises a voltage generator arrangement 21, a voltage analyzer arrangement 23 and some input circuitry 25 and output circuitry 27 and some input connectors 29 and output connectors 31 for applying the voltages generated by the voltage generator arrangement 21 to cords 33 of one or more suspension members 11 and for forwarding resulting voltages after transmission through the cords 33 towards the voltage analyzer arrangement 23.

The voltage generator arrangement 21 comprises two alternating voltage generators 35 ($G_1$, $G_2$) for generating a first and a second alternating voltage. Preferably, the two alternating voltages have same waveforms but are shifted by 180° with respect to each other. The generated alternating voltages may have no DC component, i.e. the voltage is symmetrically alternating around 0V. Alternatively, the generated alternating voltages may have an additional DC component, i.e. the voltage is periodically alternating around a non-zero DC voltage. The first and second alternating voltages are applied to two different cords 33 or groups of cords 33 being interconnected in series and or in parallel within one or more suspension members 11. For this purpose, the alternating voltage generators 35 are each connected via the input circuitry 25 including internal resistances (being represented as resistances $R_3$ and $R_4$) to input connectors 29 contacting one or more of the cords 33 comprised in first and second groups of cords 33. Additionally, the alternating voltage generator 21 comprises a pull-up voltage source 43 for applying a pull-up voltage $U_{max}$ via internal resistors $R_1$, $R_2$ to associated branches of the input circuitry 25.

It shall be noted that, in the example shown in the figure, all odd numbered cords 1, 3, 5, . . . 11 are connected in series to form a first group of cords 33 and all even numbered cords 2, 4, 6, . . . , 12 are connected in series to form a second group of cords 33. However, such configuration is only exemplary. Various other configurations of grouping cords 33 into first and second groups are imaginable. For example, a first group of cords 33 may comprise all cords of a single suspension member 11 and a second group of cords 33 may comprise all cords of another single suspension member 11, the cords 33 of a group being interconnected in parallel or some of the cords 33 of a group being interconnected in parallel and being serially connected to another portion of the group of cords 33.

The applied voltages are transmitted through the cords 33 or groups of cords. At opposing ends, the cords 33 or groups of cords are connected via output connectors 31 and output circuitry 27 to the voltage analyzer arrangement 23. In the voltage analyzer arrangement 23, the ends of the two or more the cords 33 or groups of cords are interconnected via an electrical resistance $R_5$ thereby forming a neutral point in the entire circuitry. The voltage analyzer arrangement 23 is adapted for measuring a neutral point voltage resulting upon superimposing the resulting alternating voltages occurring at the ends of the cords 33 or groups of cords after transmission through the entire suspension member(s) 11. The resulting superimposed voltage is referred to as neutral point voltage as at the neutral point, both shifted alternating voltages should neutralize each other as long as electrical characteristics through the cords or groups of cords are same. Accordingly, under normal circumstances, the neutral point voltage should have a zero alternating voltage component.

However, upon any deteriorations in the cords modifying their electrical characteristics, such modifications generally lead to a lacking neutralization of the phase-shifted alternating voltages, such that the resulting non-zero neutral point voltage may serve as a good indicator for any change in an integrity status of the suspension member arrangement 9.

In the example shown in FIG. 2, the neutral point voltage is indirectly measured based on the measurements of two voltages $U_3$ and $U_4$ against ground potential using voltmeters 37, 39. Therein, one voltmeter 37 is connected via the output circuitry 27 and one of the output connectors 31 to the first one of the groups of cords 33 whereas the other voltmeter 39 being connected via the output circuitry 27 and another one of the output connectors 31 to the second one of the groups of cords 33. Both portions of the output circuitry 27 are interconnected via the electrical resistance $R_5$. Measuring results of both voltmeters 37, 39 may be evaluated and analyzed by an analyzing unit 41. Accordingly, the analyzing unit 41 may detect a first type of deterioration in the integrity status of the suspension member arrangement 9 based on the analysis of the neutral point voltage, particularly based on any deviation from a non-zero AC component of the neutral point voltage.

It shall be noted that other circuitry including one or more voltmeters and analyzing units may be applied for measuring the neutral point voltage, as described for example in more detail in the applicant's prior art.

Additionally to the neutral point voltage, the monitoring device 17 may determine voltages which result after a voltage drop along cords 33 of one of the groups of cords and which are referred to herein as resulting voltages. The voltmeters 37, 39 measuring the voltages $U_3$, $U_4$ may enable measuring such resulting voltages, optionally additionally taking into account measurements of additional voltmeters 45, 47 measuring voltages $U_1$, $U_2$ as applied by the alternating voltage generator arrangement 21 to the input connectors 29. Also, the resulting voltages may be evaluated and analyzed by the analyzing unit 41. Accordingly, the analyzing unit 41 may further detect a second type of deterioration in the integrity status of the suspension member arrangement 9 based on a detected modification in the measured resulting voltages, particularly based on any substantial deviations of currently measured values for such resulting voltages in comparison to initially measured (i.e. before any significant deterioration took place) values or reference values for such resulting voltages.

Accordingly, during normal operation conditions of the monitoring device 17, the monitoring device 17 may detect two types of deteriorations in an integrity status of the suspension member 11. The first type relates e.g. to failures such as interruptions or electrical shorts in one of the groups of cords. This first type of deterioration may be detected based on an analysis of the neutral point voltage. The second type of deterioration particularly relates e.g. to wear effects in the cords 33 resulting in gradually increasing the electric resistance over time. The second type of deterioration may be detected based on an analysis of the resulting voltage drop along the cords 33.

In order to guarantee safe operation of an elevator 1, the elevator does not only comprise a monitoring device 17 for monitoring an integrity status of its suspension member arrangement 9, but, furthermore, the monitoring device 17 itself is specifically configured and operated for executing specific self-testing procedures. Such self-testing procedures shall reliably detect any failures or malfunctions within the monitoring device 17 which otherwise could avoid reliably detecting any deteriorations in the suspension member arrangement 9.

For such purpose, the monitoring device 17 comprises a controller component 49. The controller component 49 may control the operation of the alternating voltage generators 35. Particularly, the controller component 49 may control each of the voltage generators $G_1$, $G_2$. Furthermore, the controller component 49 may communicate with the analyzing unit 41 of the voltage analyzer arrangement 23.

For performing a self-testing procedure, the controller component 49 may temporarily interrupt the normal monitoring operation of the monitoring device 17. Particularly, the controller component 49 may temporarily modify an operation of the alternating voltage generator arrangement 21 such as to modify the generated electric voltages in a way in that modifications in the applied electric voltages upon transmission through the cords 33 are systematically induced which, under normal operation conditions of the monitoring device 17, would be interpreted by the voltage analyzer arrangement 23 of the monitoring device 17 as indicating a critical deterioration in the integrity status of the suspension member arrangement 9. The controller component 49 may then communicate with the voltage analyzer arrangement 23, particularly with its analyzing unit 41, and verifying whether the induced "virtual" deterioration is correctly detected. As long as this is the case, normal operation of the monitoring device 17 may be resumed, i.e. the controller component 49 may control the voltage generators 35 to generate their standard monitoring voltages. However, in case the controller component 49 determines that the provoked "virtual" deterioration was not correctly detected in the voltage analyzer arrangement 23, this will be taken as indicating any failure or malfunction in the monitoring device 17 and suitable self-test-failure-actions may be initiated.

Particularly, as the monitoring device 17 is adapted for detecting the above-mentioned two types of deteriorations, the self-testing procedure may also comprise two types of sub-procedures.

In a first sub-procedure, the controller component 49 may control the alternating voltage generators 35 to, first, temporarily switch-off the first voltage generator $G_1$. Accordingly, no first alternating voltage is applied anymore to the first group of cords 33 and an asymmetry in the resulting voltages after transmission through both groups of cords 33 at the neutral point is induced. As a consequence, the neutral point voltage should have a non-zero AC component. Subsequently, the controller component 49 may control the alternating voltage generators 35 to switch-on the first voltage generator $G_1$ again and switch-off the second voltage generator $G_2$ instead. Also, in this configuration, an asymmetry in the resulting voltages is induced resulting in a non-zero AC component at the neutral point.

In both situations, the voltage analyzer arrangement 23 should detect the non-zero AC component and should indicate that a significant deterioration in the integrity status of the suspension member arrangements 9 was detected. If this is not the case for both sub-procedures, this will be recognized by the controller component 49 as indicating a malfunction in the monitoring device 17. Such malfunction could be for example a failure in the alternating voltage generators 35, in the input and output circuitries 25, 27 or in the input and output connectors 29, 31 or their contacts to the cords 33.

In a second sub-procedure, the controller component 49 may control the alternating voltage generators 35 for temporarily reducing an amplitude of the generated alternating voltages. This amplitude may refer to the AC component only or may refer to a combination of an AC component and a DC component. Specifically, the amplitudes may be reduced to a value which is lower than a value which, under normal operation conditions of the monitoring device 17, would be interpreted by the voltage analyzer arrangement 23 of the monitoring device 17 as indicating the second type of deterioration in the integrity status of the suspension member arrangement 9.

Again, if the temporarily induced "virtual" deterioration is correctly detected by the voltage analyzer arrangement 23, the controller component 49 may control the voltage generator arrangement 21 to resume normal operation for continuing standard monitoring. However, if the "virtual" deterioration is not correctly detected, this may be interpreted by the controller component 49 as indicating a malfunction in the monitoring device 17 and a suitable self-test-failure-action may be initiated.

For initiating the self-test-failure-action, the monitoring device 17 or, particularly, its controller component 49 may for example communicate with the elevator controller 19. Particularly, as a type of self-test-failure-action, the elevator controller 19 may be instructed to stop normal operation of the elevator 1. For example, any motion of the drive traction machine 13 driving the elevator car 3 may be stopped, immediately or after an evacuation of passengers. Additionally or alternatively, the monitoring device 17 may issue an alarm or initiate issuing an alarm e.g. in a remote control center.

Finally, it should be noted that the term "comprising" does not exclude other elements or steps and the "a" or "an" does not exclude a plurality. Also, elements described in association with different embodiments may be combined.

In accordance with the provisions of the patent statutes, the present invention has been described in what is considered to represent its preferred embodiment. However, it should be noted that the invention can be practiced otherwise than as specifically illustrated and described without departing from its spirit or scope.

LIST OF REFERENCE SIGNS

1 elevator
3 car
5 counterweight
7 elevator shaft
9 suspension member arrangement
11 suspension member
13 traction machine
15 traction sheave
17 monitoring device
19 control device
21 voltage generator arrangement
23 voltage analyzer arrangement
25 input circuitry
27 output circuitry
29 input connectors
31 output connectors
33 cords
35 voltage generator
37 voltmeter
39 voltmeter
41 analyzing unit
43 pull-up voltage source
45 voltmeter
47 voltmeter
49 controller component

The invention claimed is:

1. A method for self-testing a monitoring device monitoring an integrity status of a suspension member arrangement in an elevator, wherein the monitoring device generates electric voltages and applies the electric voltages to electrically conductive cords in suspension members of the suspension member arrangement, and wherein the monitoring device detects a deterioration in the integrity status based on modifications in the applied electric voltages upon transmission through the cords, the method comprising the steps of:

modifying the generated electric voltages to systematically induce modifications in the applied electric voltages which modified applied electrical voltages upon transmission through the cords would be interpreted by the monitoring device as indicating the deterioration in the integrity status;

verifying whether the deterioration in the integrity status is correctly detected; and initiating a self-test-failure-action in the elevator when the deterioration in the integrity status is not correctly detected.

2. The method according to claim 1 wherein the monitoring device generates the electric voltages as first and second alternating voltages being phase-shifted with respect to each other and analyzes a neutral point voltage resulting upon applying the first and second alternating voltages to a first group of the cords and a second group of the cords respectively in the suspension members of the suspension member arrangement respectively, transmission of the first and second alternating voltages through the first and second groups of cords and superimposing the transmitted first and second alternating voltages, and wherein the monitoring device detects a first type of deterioration in the integrity status based on the analysis of the neutral point voltage, the method including the steps of:

modifying the generated first and second alternating voltages to induce modifications in the neutral point voltage upon transmission through the cords that would be interpreted by the monitoring device as indicating the first type of deterioration in the integrity status;

verifying whether the first type of deterioration in the integrity status is correctly detected; and initiating the self-test-failure-action in the elevator when the first type of deterioration in the integrity status is not correctly detected.

3. The method according to claim 2 including:

modifying the generated first and second alternating voltages by temporarily switching-off the first alternating voltage while generating the second alternating voltage and verifying whether the first type of deterioration in the integrity status is correctly detected;

subsequently modifying the generated first and second alternating voltages by temporarily switching-off the second alternating voltage while generating the first alternating voltage and verifying whether the first type of deterioration in the integrity status is correctly detected; and initiating the self-test-failure-action in the elevator when the first type of deterioration in the integrity status is not correctly detected for both modifications.

4. The method according to claim 2 wherein the monitoring device measures resulting voltages after a voltage drop along the cords in the suspension members of the suspension member arrangement upon applying the first and second alternating voltages, and wherein the monitoring device detects a second type of deterioration in the integrity status based on a detected modification in the measured resulting voltages, the method including the steps of:

modifying the generated first and second voltages to induce modifications in the resulting voltages that would be interpreted by the monitoring device as indicating the second type of deterioration in the integrity status;

verifying whether the second type of deterioration in the integrity status is correctly detected; and initiating the self-test-failure-action in the elevator when the second type of deterioration in the integrity status is not correctly detected.

5. The method according to claim 4 including modifying the generated first and second alternating voltages by temporarily reducing a magnitude of the generated first and second alternating voltages to a value which is lower than a resulting voltage value that would be interpreted by the monitoring device as indicating the second type of deterioration in the integrity status.

6. The method according to claim 1 wherein the monitoring device measures resulting voltages after a voltage drop along the cords in the suspension members of the suspension member arrangement upon application of the generated electric voltages, and wherein the monitoring device detects a specific type of deterioration in the integrity status based on a detected modification in the measured resulting voltages, the method including the steps of:

modifying the generated electric voltages to induce modifications in the resulting voltages that would be interpreted by the monitoring device as indicating the specific type of deterioration in the integrity status;

verifying whether the specific type of deterioration in the integrity status is correctly detected; and initiating a self-test-failure-action in the elevator when the specific type of deterioration in the integrity status is not correctly detected.

7. The method according to claim 6 including modifying the generated electric voltages by temporarily reducing a magnitude of the generated electric voltages to a value which is lower than a resulting voltage value that would be interpreted by the monitoring device as indicating the specific type of deterioration in the integrity status.

8. The method according to claim 1 including periodically performing the method steps during operation of the monitoring device.

9. The method according to claim 1 including performing the method steps upon an occurrence of predetermined events during operation of the monitoring device.

10. A monitoring device for performing the method according to claim 1 to monitor the integrity status of the suspension member arrangement in the elevator, the monitoring device comprising:

a voltage generator arrangement for generating the generated electric voltages and being connected to the cords in the suspension members of the suspension arrangement by input circuitry, output circuitry, input connectors and output connectors for applying the generated electric voltages to cords;

a voltage analyzer arrangement for detecting the deterioration in the integrity status based on the modifications in the generated electric voltages transmitted through the cords; and a controller component connected to the voltage generator arrangement and to the voltage analyzer arrangement for controlling operation of the monitoring device.

11. The monitoring device according to claim 10 wherein the voltage generator arrangement generates the electric voltages as first and second alternating voltages being phase-shifted with respect to each other and the voltage analyzer arrangement analyzes a neutral point voltage resulting upon applying the first and second alternating voltages to a first group of the cords and a second group of the cords respectively in the suspension members of the suspension member arrangement respectively, transmission of the first and second alternating voltages through the first and second groups of cords and superimposing the transmitted first and second alternating voltages, and wherein the monitoring device detects a specific type of deterioration in the integrity status based on the analysis of the neutral point voltage by:

modifying the generated first and second alternating voltages to induce modifications in the neutral point voltage upon transmission through the cords that would be interpreted by the monitoring device as indicating the specific type of deterioration in the integrity status;

verifying whether the specific type of deterioration in the integrity status is correctly detected; and initiating the self-test-failure-action in the elevator when the specific type of deterioration in the integrity status is not correctly detected.

12. The monitoring device according to claim 10 wherein the voltage analyzer arrangement measures resulting voltages after a voltage drop along the cords in the suspension members of the suspension member arrangement upon application of the generated electric voltages, and wherein the monitoring device detects a specific type of deterioration in the integrity status based on a detected modification in the measured resulting voltages by:

modifying the generated electric voltages to induce modifications in the resulting voltages that would be interpreted by the monitoring device as indicating the specific type of deterioration in the integrity status;

verifying whether the specific type of deterioration in the integrity status is correctly detected; and initiating a self-test-failure-action in the elevator when the specific type of deterioration in the integrity status is not correctly detected.

13. An elevator comprising:

a suspension member arrangement including electrically conductive cords in suspension members of a suspension member arrangement; and a monitoring device according to claim 10 connected to the cords in the suspension member arrangement.

* * * * *